US007635032B2

(12) United States Patent
Saur et al.

(10) Patent No.: US 7,635,032 B2
(45) Date of Patent: Dec. 22, 2009

(54) HAND-HELD TOOL COMPRISING A SHAFT AND A LIFTING BEARING WHICH IS MOUNTED ON THE SHAFT

(75) Inventors: Dietmar Saur, Gomaringen (DE); Helmut Heinzelmann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/720,126

(22) PCT Filed: Aug. 29, 2006

(86) PCT No.: PCT/EP2006/065767

§ 371 (c)(1),
(2), (4) Date: May 24, 2007

(87) PCT Pub. No.: WO2007/039359

PCT Pub. Date: Apr. 12, 2007

(65) Prior Publication Data

US 2008/0011499 A1 Jan. 17, 2008

(30) Foreign Application Priority Data

Oct. 5, 2005 (DE) ..... 10 2005 047 600

(51) Int. Cl.
*B25D 17/00* (2006.01)

(52) U.S. Cl. ..... 173/47; 173/109; 173/200; 173/201

(58) Field of Classification Search ..... 173/104, 173/109, 47, 48, 200, 201
See application file for complete search history.

(56) References Cited

U.S. PATENT DOCUMENTS 4,446,931 A * 5/1984 Bleicher et al. ..... 173/48
5,277,259 A * 1/1994 Schmid et al. ..... 173/13
6,035,945 A 3/2000 Ichijyou et al.
6,192,996 B1 2/2001 Sakaguchi et al.
6,666,284 B2 * 12/2003 Stirm ..... 173/97
6,918,450 B2 * 7/2005 Lebisch et al. ..... 173/104
6,971,455 B2 * 12/2005 Shibata et al. ..... 173/48
7,296,635 B2 * 11/2007 Droste ..... 173/48
2004/0188117 A1 * 9/2004 Lebisch et al. ..... 173/48
2004/0231866 A1 * 11/2004 Droste ..... 173/48
2006/0048955 A1 * 3/2006 Saur et al. ..... 173/48
2006/0113097 A1 * 6/2006 Simm et al. ..... 173/48
2007/0102174 A1 * 5/2007 Duesselberg et al. ..... 173/48

FOREIGN PATENT DOCUMENTS

| | | |
|---|---|---|
| DE | 35 03 507 | 8/1986 |
| DE | 37 32 288 | 4/1989 |
| DE | 198 01 986 | 10/1998 |
| EP | 1 375 076 | 1/2004 |
| EP | 1 422 028 | 5/2004 |
| WO | 89/11955 | 12/1989 |

* cited by examiner

*Primary Examiner*—Paul R. Durand
*Assistant Examiner*—Michelle Lopez
(74) *Attorney, Agent, or Firm*—Michael J. Striker

(57) ABSTRACT

A hand-held drill hammer has a housing, a shaft (12) connected to a drive shaft (30), and a lifting bearing (14). The lifting bearing (14) is supported and the shaft (12) for converting rotary motion into a reciprocating motion. In a first switching configuration, a percussion drive connection exists between the shaft (12) and the lifting bearing (14). In a second switching configuration, the percussion drive connection is interrupted. The lifting bearing (14) may be fixed with respect to a reference system of the housing in the second switching configuration.

15 Claims, 5 Drawing Sheets

HAND-HELD TOOL COMPRISING A SHAFT AND A LIFTING BEARING WHICH IS MOUNTED ON THE SHAFT

CROSS-REFERENCE TO RELATED APPLICATIONS

This application claims priority under 35U.S.C. 119 (a)-(d) to German patent application number DE 10 2005 047 6007, filed 5 Oct. 2005.

BACKGROUND OF THE INVENTION

The invention is based on a hand-held tool having a shaft and having a lifting bearing, supported on the shaft.

A hand-held tool, in particular a drill hammer, having a shaft and having a lifting bearing, supported on the shaft, for converting a rotary motion of the shaft into a reciprocating motion is known. A gear of the hand-held tool, which gear includes the lifting bearing and the shaft, is shiftable. In particular, a rotary drive of a tool chuck and a percussion drive of a percussion mechanism can be switched on and off. For switching the aforementioned functions on and off, the shaft can be displaced into a plurality of switching configurations. In a first switching configuration, a percussion drive connection that is fixed against relative rotation exists between the shaft and the lifting bearing, so that the percussion drive is switched on. In a second switching configuration, the percussion drive connection is interrupted, so that the percussion mechanism is deactivated. Further switching configurations pertain to the switching on and off of the rotary drive and a variolock function.

SUMMARY OF THE INVENTION

The invention is based on a hand-held tool, in particular a drill hammer, having a shaft and having a lifting bearing, supported on the shaft, for converting a rotary motion into a reciprocating motion, in which in at least a first switching configuration a percussion drive connection, which is fixed against relative rotation, exists between the shaft and the lifting bearing and in at least a second switching configuration a percussion drive connection, is interrupted.

It is proposed that the hand-held tool include a retention means, which fixes the lifting bearing in the first switching configuration. As a result, the lifting bearing, despite the interrupted percussion drive connection, can be prevented from generating a reciprocating motion as a result of friction of the bearing of the lifting bearing on the shaft. By the avoidance of the unwanted reciprocating motions, a hand-held tool with improved running smoothness can be achieved, since no vibration that impairs the comfort of using the hand-held tool can be generated by the reciprocating motions.

The provisions of the invention can be employed especially advantageously in drill hammers, but in principle it would also be conceivable to use them in other hand-held tools that have a reciprocating or percussion drive that can be switched on and off. The term "fixation" refers in this connection to a reference system of a housing of the hand-held tool. The shaft on which the lifting bearing is supported is, in most hand-held tools of this generic type, a short intermediate shaft. In principle, however, the lifting bearing could be supported on a drive shaft or motor shaft. The invention is especially advantageously usable for fixation or braking of lifting bearings embodied as wobble bearings. In principle, however, its use in conjunction with eccentric bearings or deep-groove bearings would also be conceivable.

In a refinement of the invention, it is proposed that the retention means is located on a switch element for axial displacement of the shaft. As a result, an axial motion of the switch element that is to be performed anyway during a shifting operation can be used to make a connection that fixes the lifting bearing.

A lifting bearing that rotates at high speed can be braked by friction on the lifting bearing when the connection is made, if the switch element in the first switching configuration has an at least friction-locking rotary connection with the lifting bearing. The friction lock can be supplemented, after the braking of the lifting bearing, by a form lock or can fix the lifting bearing on its own.

The aforementioned advantages can, however, be realized independently of the switch element whenever the hand-held tool includes a friction lining for making a friction-locking rotary connection between the lifting bearing and the retention means. The friction lining can be embodied especially effectively and economically by a rubber ring.

A secure hold for fixation of the lifting bearing can be attained if the lifting bearing has a detent profile on one edge. The term "edge" is intended in this connection to mean an end region in an axial direction.

If the hand-held tool includes a form-locking element for form-locking connection of the lifting bearing to the switch element in a circumferential direction relative to the shaft, then in a simple way, a connection fixed against relative rotation can be made between the lifting bearing and the switch element. The form-locking element can be located either on the lifting bearing or on the switch element and is advantageously supplemented by a corresponding form-locking element on the respective other component. The form-locking element advantageously has a multidigital point symmetry, for instance a hexagonal or octagonal symmetry, so that a connection can be made in a plurality of rotary positions.

A shifting motion of the switch element can be used to fix the lifting bearing, if the form-locking element is provided for engaging a corresponding form-locking element in a switching motion direction of the switch element.

Convenient release of a tooth-on-tooth position of the retention means can be attained if the hand-held tool includes a synchronizing means for synchronizing the lifting bearing with the retention means. The synchronizing means may for instance be embodied as a synchronizing spring or as a synchronizing ring.

If the percussion drive connection is intended for driving a pneumatic percussion mechanism, then unwanted reciprocating motions of the percussion mechanism in the shut-off state can be avoided, and running smoothness of the hand-held tool can be improved in an especially lasting way. Moreover, additional noise production from unwanted, comparatively slight impacting of the beater on the percussion bolt can be avoided.

Further advantages will become apparent from the ensuing description of the drawings. In the drawings, exemplary embodiments of the invention are shown. The drawings, description and claims include numerous characteristics in combination. One skilled in the art will expediently consider these characteristics individually as well as put them together to make useful further combinations.

DESCRIPTION OF THE PREFERRED EMBODIMENTS

Figure 1:
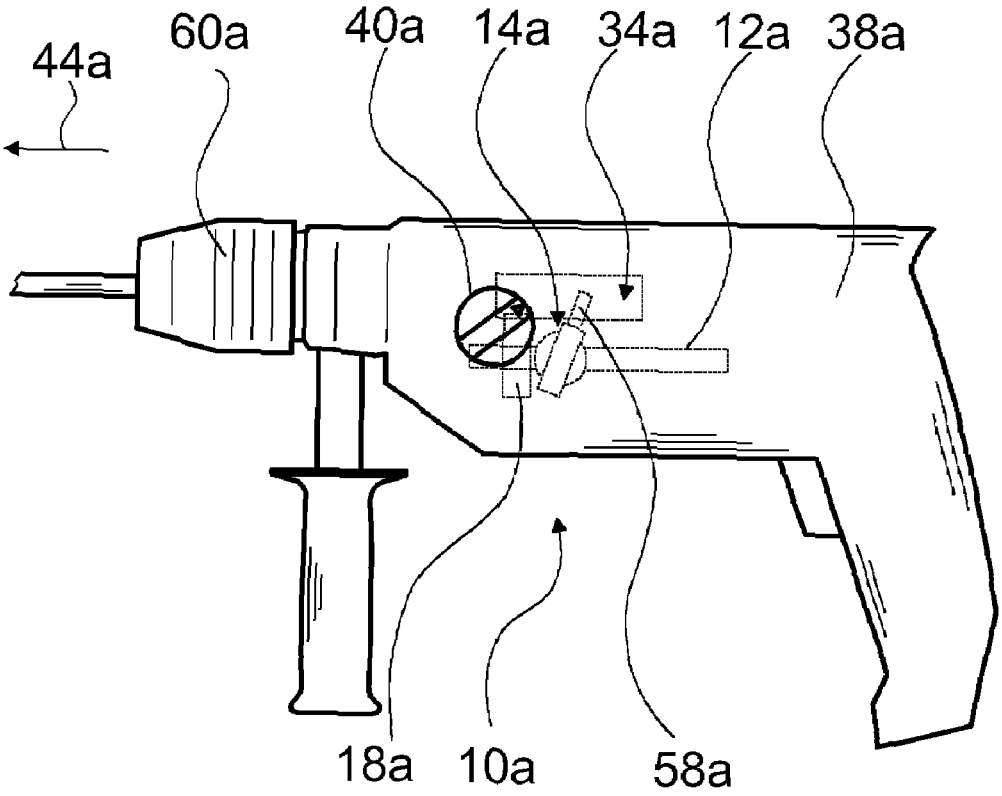
FIG. 1, a drill hammer, having a shaft and a lifting bearing supported on the shaft.

FIG. 1 shows a hand-held tool, embodied as a drill hammer 10*a*, with a shaft 12*a*, shown here only schematically, that as an intermediate shaft connects a drive shaft 30*a* (FIG. 2) to a lifting bearing 14*a*, supported on the shaft 12*a* and embodied as a wobble bearing, and to a rotary drive of a tool chuck 60*a*. For shifting the drill hammer 10*a* back and forth between various operating modes, the shaft 12*a* may be axially displaced via a shift knob 40*a*, supported on a housing 38*a*, and via a switch element 18*a*. For displacing the shaft 12*a*, an eccentric pin engages a leg spring 42*a* (FIGS. 3-4) of the switch element 18*a*.

In a first switching configuration, the shaft 12*a* is maximally displaced in one working direction 44*a*. At that time, a set of teeth 46*a* of the shaft 12*a* is not in engagement with a corresponding set of teeth 48*a* of an intermediate sleeve 36*a*, so that a rotary drive connection between the drive shaft 30*a* and the shaft 12*a* is interrupted. A percussion drive connection between the drive shaft 30*a* and the lifting bearing 14*a* is generated by the engagement of a set of external teeth 50*a* of the intermediate sleeve 36*a*; this sleeve is movable axially counter to the force of a spring, with a corresponding set of internal teeth 52*a* of the lifting bearing 14*a*. Therefore in the first switching configuration, only a percussion mechanism 34*a*, but not the rotary drive of the drill hammer 10*a*, is switched on, and so the drill hammer 10*a* can be operated in a chiseling mode.

Figure 2:
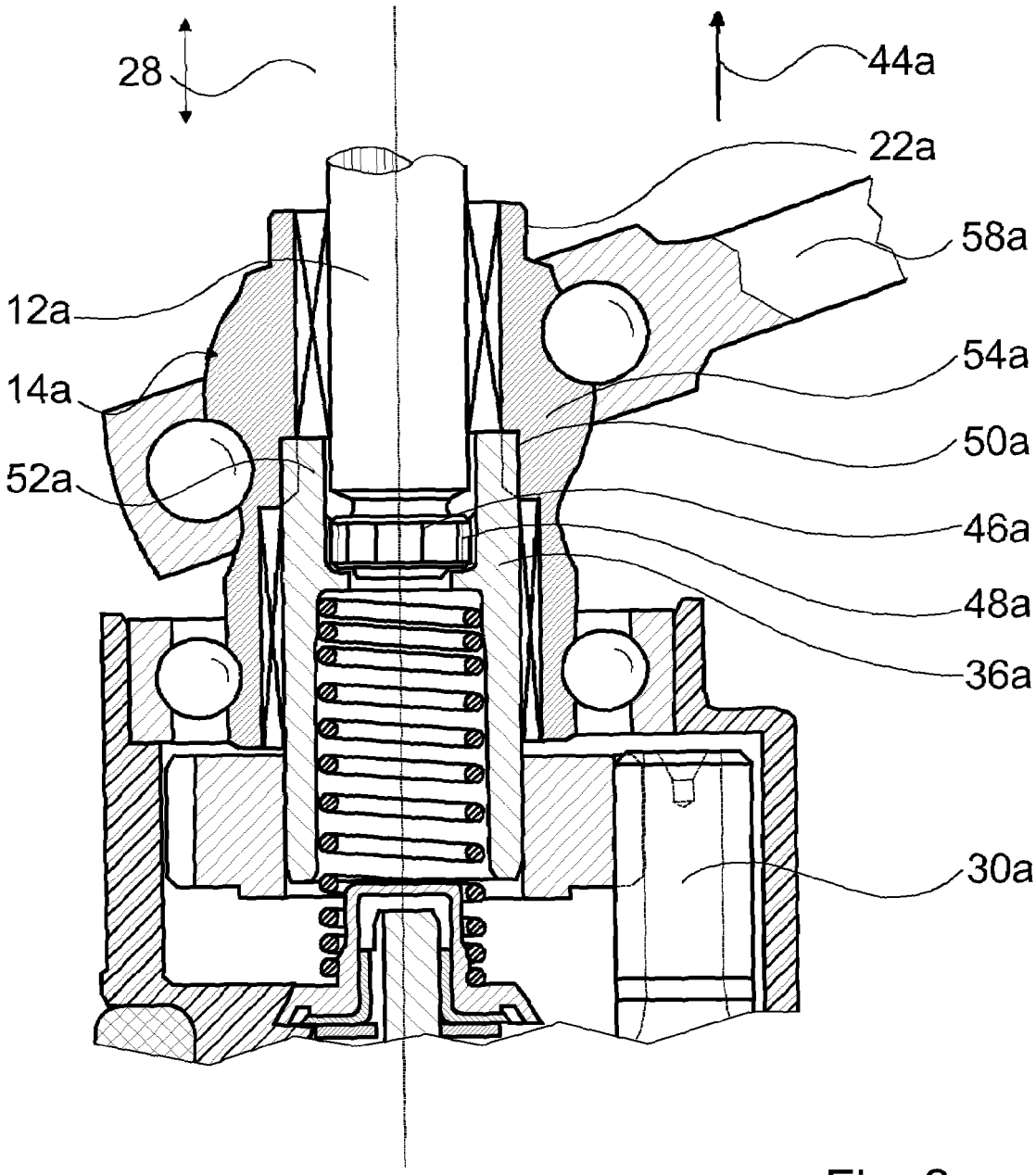
FIG. 2, a gear of the drill hammer with the shaft of FIG. 1.
Figure 3:
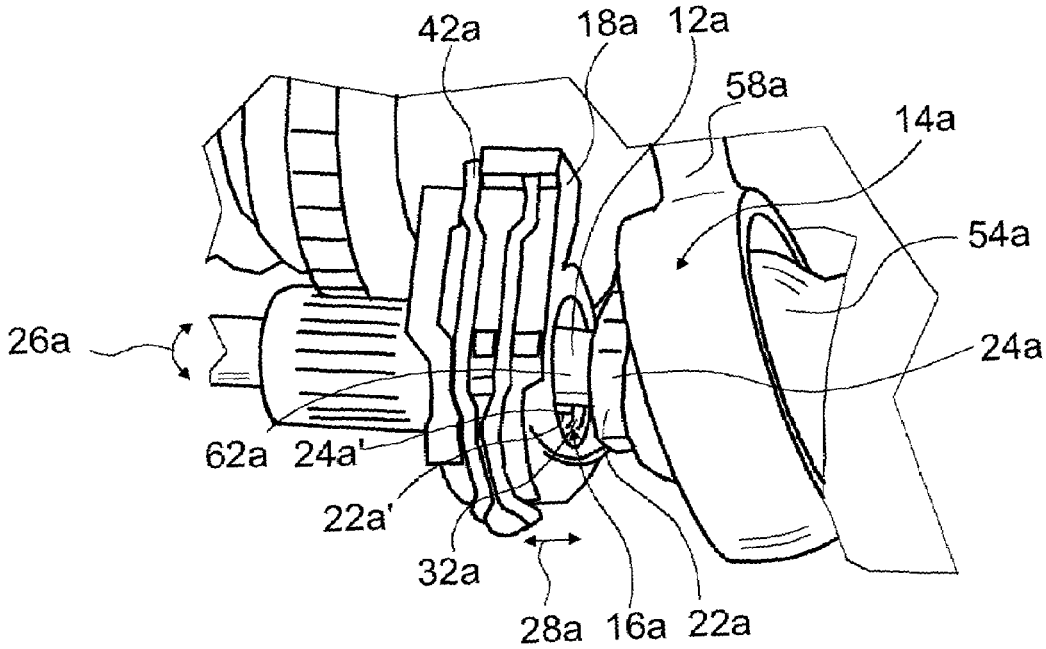
FIG. 3, the lifting bearing and the shaft of FIG. 1 as well as a switch element in a percussion drilling configuration.

In a middle switching configuration, the shaft 12*a* is in a middle position, which is shown in FIG. 2. The set of teeth 46*a* of the shaft 12*a* is then in engagement with the corresponding set of teeth 48*a* of the intermediate sleeve 36*a*, so that the rotary drive connection exists between the drive shaft 30*a* and the shaft 12*a*. The percussion drive connection between the drive shaft 30*a* and the lifting bearing 14*a* still exists. Therefore in the middle switching configuration, both the percussion mechanism 34*a* and the rotary drive of the drill hammer 10*a* are switched on, and thus the drill hammer 10*a* can be operated in a percussion drilling mode.

In the middle switching configuration, the intermediate sleeve 36*a* generates a percussion drive connection, which is fixed against relative rotation, between the shaft 12*a* and the lifting bearing 14*a*.

In a second switching configuration, the shaft 12*a* is maximally displaced counter to the working direction 44*a*. With the shaft 12*a*, the intermediate shaft 36*a* is also axially displaced counter to the working direction 44*a* counter to the force of the spring, so that the set of teeth 46*a* of the shaft 12*a* is then in engagement with the corresponding set of teeth 48*a* of the intermediate sleeve 36*a*. The rotary drive connection thus exists between the drive shaft 30*a* and the shaft 12*a*. The percussion drive connection between the drive shaft 30*a* and the lifting bearing 14*a* is interrupted, since as a result of the displacement of the intermediate sleeve 36*a*, there is no longer engagement of the external set of teeth 50*a* with the corresponding internal set of teeth 52*a* of the lifting bearing 14*a*. In the second switching configuration, therefore only the rotary drive of the drill hammer 10*a* is switched on, and thus the drill hammer 10*a* can be operated in a rotary drilling mode.

The lifting bearing 14*a* includes a drive bearing 54*a*, through which the shaft 12*a* reaches and which has an annular groove whose axis of symmetry is inclined relative to an axis of rotation. A ring with a lever extension 58*a* is supported in the groove, via balls, and because of the inclination of the axis of symmetry relative to the axis of rotation it executes alternating pivoting motions upon rotation of the drive bearing 54*a*. The lever extension 58*a* engages a piston, not explicitly shown here, of the percussion mechanism 34*a* of the drill hammer 10*a*. The percussion drive connection is therefore intended for driving a pneumatic percussion mechanism 34*a*.

The switch element 18*a* is connected axially firmly and rotatably to the shaft 12*a* for the displacement of the shaft 12*a*. In the first switching configuration and in the middle switching configuration (FIG. 3), a gap 62*a* exists between the drive bearing 54*a* of the lifting bearing 14*a* and the switch element 18*a*; this gap disappears in the second switching configuration, or when the percussion is switched off.

Figure 6:
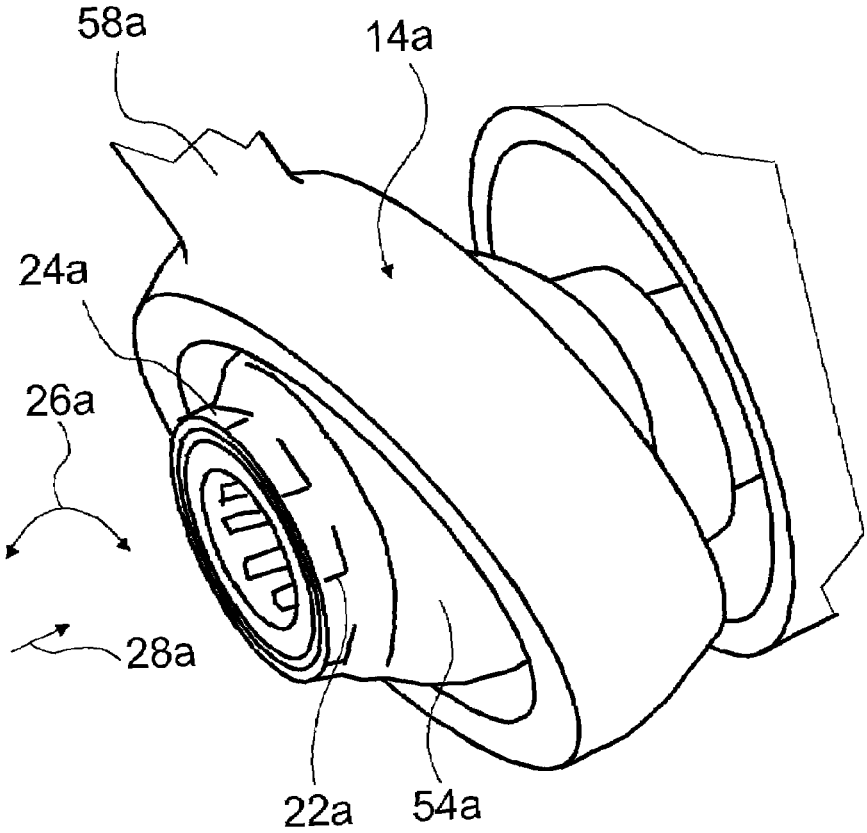
FIG. 6, the lifting bearing from FIGS. 1-5.

On one edge, toward the switch element 18*a*, of the drive bearing 54*a* of the lifting bearing 14*a*, an octagonal detent profile 22*a* is formed on integrally; it forms a form-locking element 24*a* for form-locking connection of the lifting bearing 14*a* to the switch element 18*a* in a circumferential direction 26*a* relative to the shaft 12*a* (see FIG. 6).

Figure 5:
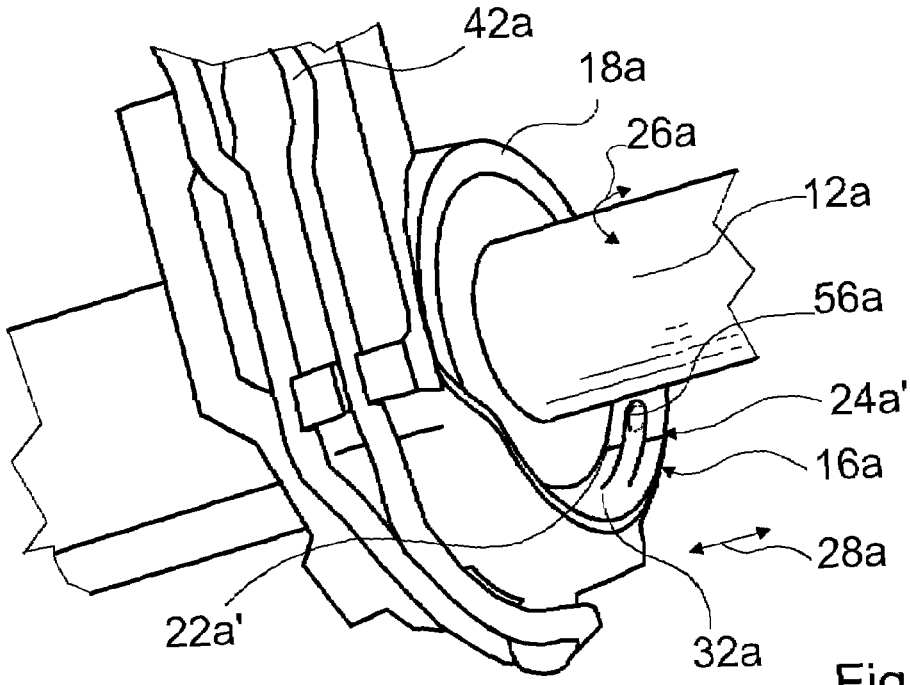
FIG. 5, the switch element and the shaft of FIGS. 1-4 without the lifting bearing.

The form-locking element 24*a* is intended for engaging a corresponding form-locking element 24*a*' or retention means 16*a* on the switch element 18*a*, counter to a switching motion direction 28*a*. The retention means 16*a* serves to fix the lifting bearing 14*a* in the second switching configuration, in which the percussion drive connection between the lifting bearing 14*a* and the drive shaft 30*a* is interrupted. The retention means 16*a* includes, besides a detent profile 22*a*', a synchronizing means 32*a*, embodied as a spring arm that can be deflected in an axial direction or in the working direction 44*a*, for synchronizing the lifting bearing 14*a* with the retention means 16*a* (FIG. 5).

Figure 4:
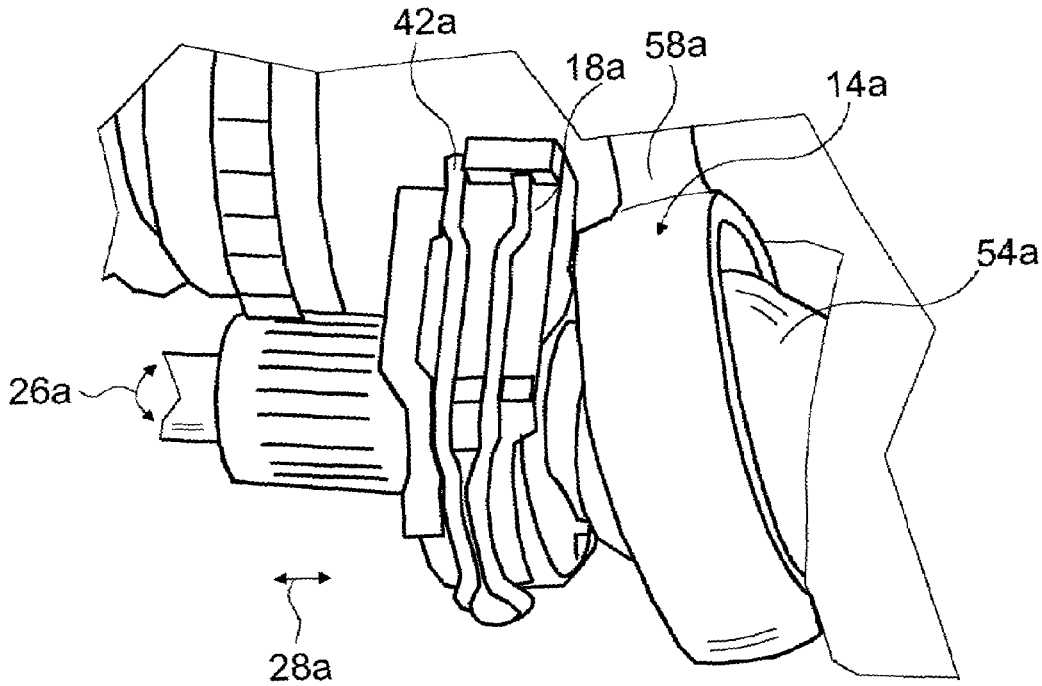
FIG. 4, the lifting bearing, shaft and switch element in a rotary drilling configuration.

A radially inward-protruding cam 56*a* is formed integrally onto the synchronizing means 32*a*. If upon displacement of the switch element 18*a*, in a shifting motion from the middle switching configuration to the second switching configuration, the cam 56 comes into contact with a corner of the detent profile 22*a*, then the synchronizing means 32*a* is deflected counter to the switching motion direction 28*a*. A radius of the detent profile 22*a*, in the middle of its edge is shorter than a radius of the position of the cam 56*a*, so that after a brief rotation of the drive bearing 54*a*, the synchronizing means 32*a* snaps over the edge of the detent profile 22*a*, and by means of the cam 56*a*, a form lock is created between the lifting bearing 14*a* and the switch element 18*a* (FIG. 4).

Figure 7:
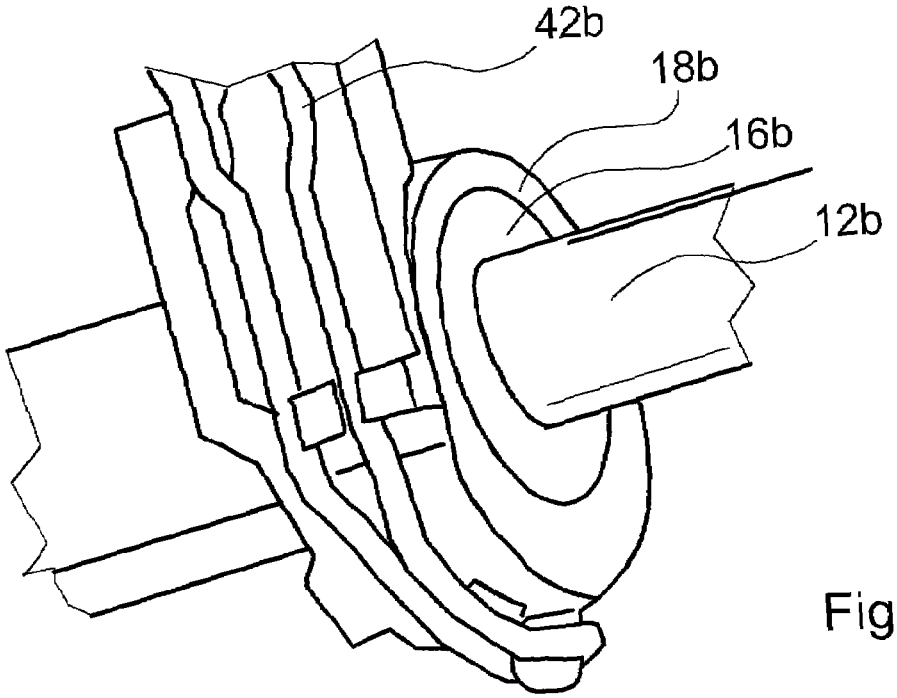
FIG. 7, a switch element with a retention means in an alternative embodiment of the invention.
Figure 8:
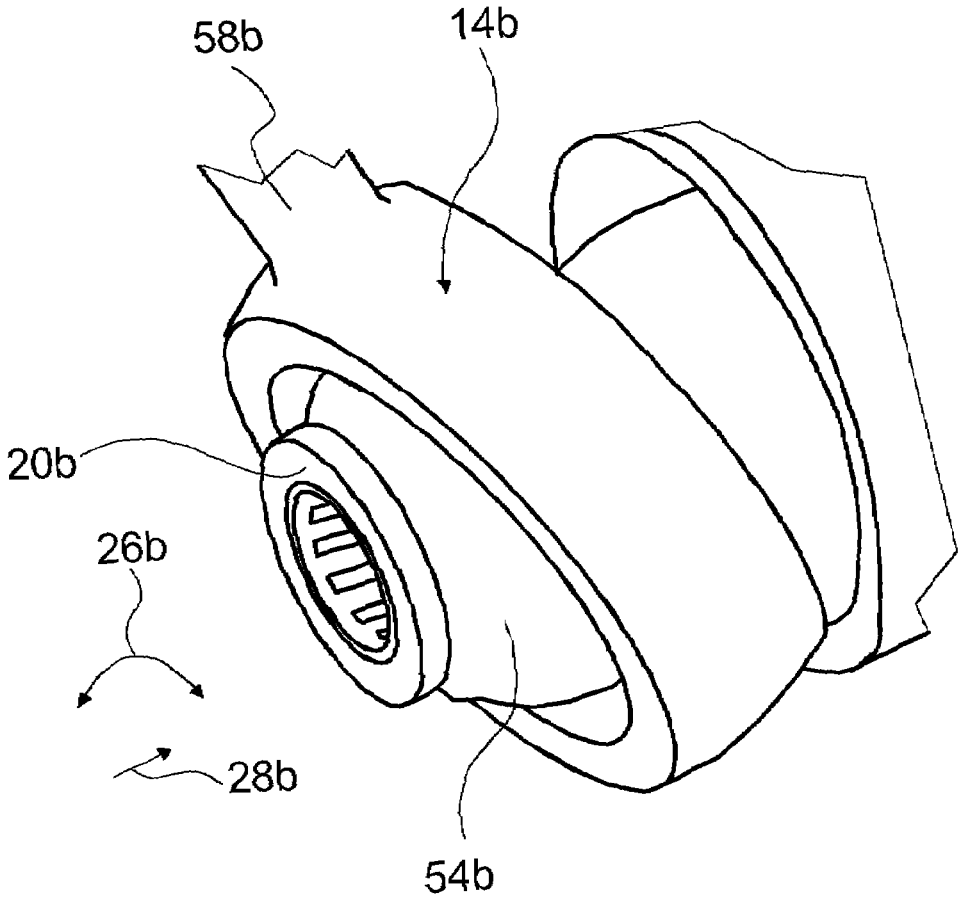
FIG. 8, a lifting bearing corresponding to the switch element of FIG. 7.

FIGS. 7 and 8 show a further embodiment of the invention. The description will be limited essentially to differences from the exemplary embodiment shown in FIGS. 1-6, to which reference should be made for characteristics that remain the same. Analogous characteristics are identified by the same reference numerals, with the letters "a" and "b" being added to distinguish the exemplary embodiments.

A retention means 16*b* shown in FIG. 7 is embodied as a flat friction face, which forms a face end, toward a lifting bearing 14*b*, of the switch element 18*b*. A friction lining 20*b*, embodied as a pressed-on rubber ring, is located on a front edge of a drive bearing 54*b* of the lifting bearing 14*b* and comes into contact with the retention means 16*b* in the second switching configuration.

The switch element 18*b* therefore, in the second switching configuration, has a friction-locking rotary connection with the lifting bearing 14*b*. If the operating mode of a drill hammer 10*b*, including the switch element 18*b*, is shifted during operation of the drill hammer 10*b*, then the retention means 16*b* brakes the rotating lifting bearing 14*b* as soon as the friction lining 20*b* comes into contact with the retention means 16*b*. A synchronizing means and a form-locking element can advantageously be dispensed with, in the embodiment of the invention shown in FIGS. 7 and 8. A contact pressure of the retention means 16*b* on the friction lining 20*b* is so great that a frictional force of the friction lock overcompensates for any moment created by bearing friction.

The invention claimed is:

1. A hand-held tool, in particular a drill hammer (10), comprising a housing, a shaft (12) connected to a drive shaft (30), a lifting bearing (14) supported on the shaft (12) for converting a rotary motion into a reciprocating motion, wherein said shaft (12) and said lifting bearing (14) are configured so that in at least a first switching configuration a percussion drive connection exists between said shaft (12) and said lifting bearing (14) and in at least a second switching configuration the percussion drive connection is interrupted, a retention means (16) which fixes said lifting bearing (14) with respect to a reference system of said housing in the second switching configuration, wherein the retention means (16) is located on a switch element (18) for axial displacement of the shaft (12), and wherein a detent profile (22*a*) is provided on one edge of the lifting bearing (14*a*) as means for fixation relative to a reference system of a housing of the hand-held tool, wherein the switch element (18) in the second switching configuration has an at least friction-locking rotary connection with the lifting bearing (14).

2. The hand-held tool as defined by claim 1, further comprising a friction lining (20) for making a friction-locking rotary connection between the lifting bearing (14) and the retention means (16).

3. The hand-held tool as defined by claim 1, further comprising a form-locking element (24*a*) for form-locking connection of the lifting bearing (14*a*) to the switch element (18*a*) in a circumferential direction (26*a*) relative to the shaft (12*a*).

4. The hand-held tool as defined by claim 3, wherein the form-locking element (24*a*) is provided for engaging a corresponding form-locking element (24*a*') in a switching motion direction (28*a*) of the switch element (18*a*).

5. The hand-held tool as defined by claim 1, further comprising a synchronizing means (32*a*) for synchronizing the lifting bearing (14*a*) with the retention means (16*a*).

6. The hand-held tool as defined by claim 1, wherein the percussion drive connection is configured for driving a pneumatic percussion mechanism (34).

7. A hand-held tool, in particular a drill hammer (10), comprising a housing, a shaft (12) connected to a drive shaft (30), a lifting bearing (14) supported on the shaft (12) for converting a rotary motion into a reciprocating motion, wherein said shaft (12) and said lifting bearing (14) are configured so that in at least a first switching configuration a percussion drive connection exists between said shaft (12) and said lifting bearing (14) and in at least a second switching configuration the percussion drive connection is interrupted, a retention means (16) which fixes said lifting bearing (14) with respect to a reference system of said housing in the second switching configuration, wherein the retention means (16) is located on a switch element (18) for axial displacement of the shaft (12), and wherein a detent profile (22*a*) is provided on one edge of the lifting bearing (14*a*) as means for fixation relative to a reference system of a housing of the hand-held tool, further comprising a friction lining (20) for making a friction-locking rotary connection between the lifting bearing (14) and the retention means (16).

8. A hand-held tool as defined in claim 7, further comprising a form-locking element (24*a*) for form-locking connection of the lifting bearing (14*a*) to the switch element (18*a*) in a circumferential direction (26*a*) relative to the shaft (12*a*).

9. A hand-held power tool as defined in claim 8, wherein the form-locking element (24*a*) is provided for engaging a corresponding form-locking element (24*a*') in a switching motion direction (28*a*) of the switch element (18*a*).

10. A hand-held power tool as defined in claim 7, further comprising a synchronizing means (32*a*) for synchronizing the lifting bearing (14*a*) with the retention means (16*a*).

11. A hand-held power tool as defined in claim 7, wherein the percussion drive connection is configured for driving a pneumatic percussion mechanism (34).

12. A hand-held power tool, in particular a drill hammer (10), comprising a housing, a shaft (12) connected to a drive shaft (30), a lifting bearing (14) supported on the shaft (12) for converting a rotary motion into a reciprocating motion, wherein said shaft (12) and said lifting bearing (14) are configured so that in at least a first switching configuration a percussion drive connection exists between said shaft (12) and said lifting bearing (14) and in at least a second switching configuration the percussion drive connection is interrupted, a retention means (16) which fixes said lifting bearing (14) with respect to a reference system of said housing in the second switching configuration, wherein the retention means (16) is located on a switch element (18) for axial displacement of the shaft (12), and wherein a detent profile (22*a*) is provided on one edge of the lifting bearing (14*a*) as means for fixation relative to a reference system of a housing of the hand-held tool, further comprising a form-locking element (24*a*) for form-locking connection of the lifting bearing (14*a*) to the switch element (18*a*) in a circumferential direction (26*a*) relative to the shaft (12*a*).

13. A hand-held power tool as defined in claim 12, wherein the form-locking element (24*a*) is provided for engaging a corresponding form-locking element (24*a*') in a switching motion direction (28*a*) of the switch element (18*a*).

14. A hand-held power tool as defined in claim 12, further comprising a synchronizing means (32*a*) for synchronizing the lifting bearing (14*a*) with the retention means (16*a*).

15. A hand-held power tool as defined in claim 12, wherein the percussion drive connection is configured for driving a pneumatic percussion mechanism (34).

* * * * *